US007421866B2

(12) United States Patent
Kim

(10) Patent No.: US 7,421,866 B2
(45) Date of Patent: Sep. 9, 2008

(54) WASHING MACHINE AND CONTROL METHOD THEREOF

(75) Inventor: Jong Ho Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 616 days.

(21) Appl. No.: 10/719,012

(22) Filed: Nov. 24, 2003

(65) Prior Publication Data

US 2004/0149315 A1 Aug. 5, 2004

(30) Foreign Application Priority Data

Nov. 26, 2002 (KR) ..... 10-2002-0073856

(51) Int. Cl.
*D06F 39/02* (2006.01)

(52) U.S. Cl. ..... 68/17 R; 68/207

(58) Field of Classification Search ..... 68/17 R, 68/207 R

See application file for complete search history.

(56) References Cited

U.S. PATENT DOCUMENTS 2,990,707 A * 7/1961 Gerhardt et al. ..... 68/12.18

(Continued)

FOREIGN PATENT DOCUMENTS

JP 8-150289 * 6/1996

OTHER PUBLICATIONS 0 225 220 European Patent Office Jun. 1987.*

*Primary Examiner*—Frankie L Stinson

(74) *Attorney, Agent, or Firm*—McKenna Long & Aldridge LLP

(57) ABSTRACT

A washing machine and control method thereof is provided, by which a bleaching agent and a fabric softener are supplied to the washing machine using a single water supply valve. The washing machine includes a first water supply valve for supplying water to a tub upon input of a wash command; and a second water supply valve for supplying water to the tub upon input of the wash command and upon a determination of a final rinse step; a detergent reservoir, coupled to the first water supply valve, for receiving a detergent for a wash step; a bleaching agent reservoir, coupled to the second water supply valve, for receiving a bleaching agent for the wash step; and a fabric softener reservoir, coupled to the bleaching agent reservoir, for receiving a fabric softener for a final rinse step, wherein the first water supply valve is used as a dedicated valve for the detergent and said second water supply valve is used as a common input valve for the bleaching agent and fabric softener, to introduce the detergent and bleaching agent to the water in the tub for the wash step and to introduce the fabric softener to the water in the tub for the final rinse step only. The method includes steps of determining a water level; supplying water to a tub according to the determined water level, by turning on the first and second water supply valves simultaneously and turning off the second water supply valve after a first predetermined time; performing a wash step and at least one rinse step according to a selected wash course based on the determined water level; determining a final rinse step among the at least one rinse step; and performing the final rinse step according to the determined water level, by turning on the first and second water supply valves simultaneously and turning off the second water supply valve after a second predetermined time. The final rinse performing step makes use of a siphonic effect applied to the fabric softener reservoir after performing the wash step.

22 Claims, 3 Drawing Sheets

U.S. PATENT DOCUMENTS 3,033,427 A * 5/1962 Petersen ..... 222/505
3,314,254 A * 4/1967 Mandarino, Jr. et al. ..... 68/20
3,696,970 A * 10/1972 Bunnell et al. ..... 222/145.1
3,826,408 A * 7/1974 Berndt et al. ..... 222/651
3,891,123 A * 6/1975 Blackburn ..... 222/64
3,990,272 A * 11/1976 Gakhar ..... 68/17 R
4,103,520 A * 8/1978 Jarvis et al. ..... 68/12.18
4,160,367 A * 7/1979 Vona, Jr. ..... 68/17 R
4,203,307 A * 5/1980 Obata et al. ..... 68/17 R
4,265,100 A * 5/1981 Kretchman et al. ..... 238/123
4,700,554 A * 10/1987 Eichman et al. ..... 68/17 R
4,960,139 A * 10/1990 Rizzetto ..... 137/625.46
4,987,627 A * 1/1991 Cur et al. ..... 8/158
6,401,499 B1 * 6/2002 Clark et al. ..... 68/17 R

* cited by examiner

WASHING MACHINE AND CONTROL METHOD THEREOF

This application claims the benefit of Korean Application No. 10-2002-0073856 filed on Nov. 26, 2002, which is hereby incorporated by reference.

BACKGROUND OF THE INVENTION

1. Field of the Invention

The present invention relates to a washing machine, and more particularly, to a washing machine and control method thereof enabling to supply a bleaching agent and a fabric softener using one supply valve.

2. Discussion of the Related Art

In a general washing machine for washing laundry, a tub is filled with washing and rinsing water from a domestic service pipe via a main supply valve, which is typically provided at the rear of the washing machine and is situated above the tub to enable a gravity feed of the water. Meanwhile, a detergent, bleaching agent, and fabric softener may be selectively supplied together with the water according to a predetermined pattern, to thereby be introduced to the water filling the tub to perform a wash step and at least one rinse step of a selected wash course. To do so, commercially available detergents are readily dissolvable in water, and most bleaching agents and fabric softeners are sold in liquid form.

FIG. 1 illustrates a water supply system of a washing machine according to a related art is controlled by a control circuit (not shown) to fill a tub (not shown) with washing and rinsing water from a domestic service pipe 70. The water supply system includes means for selectively supplying detergent, bleaching agent, and fabric softener together with the water supply.

Referring to FIG. 1, the water supply system is comprised of a first, second, and third water supply valves 10, 30, and 50 for transmitting water from the domestic service pipe 70 to a detergent reservoir 20, a bleaching agent reservoir 40, and a fabric softener reservoir 60, respectively. The first and second water supply valves 10 and 30 are turned on when initiating a wash step, transmitting water to the detergent and bleaching agent reservoirs 20 and 40, respectively, such that the water, detergent, and bleaching agent are mixed together to be supplied to the tub. Washing is performed with the water reaches a predetermined level, and a predetermined number of rinse cycles are performed after completion of the wash step. Upon reaching the final rinse cycle but before filling the tub to the predetermined level for performing the final rinsing, the third water supply valve 50 is turned on to transmit water to the fabric softener reservoir 60, to perform final rinsing with fabric softener in the water. A dewatering step completes the wash course.

The above-described washing machine according to the related art, however, needs the first and second water supply valves connected to the detergent and bleaching agent reservoirs, respectively, despite the detergent and bleaching agent being simultaneously supplied at the beginning of the washing cycle, which increases product cost accordingly.

SUMMARY OF THE INVENTION

Accordingly, the present invention is directed to a washing machine and control method thereof that substantially obviates one or more of the problems due to limitations and disadvantages of the related art.

An object of the present invention, which has been devised to solve the foregoing problem, lies in providing a washing machine and control method thereof, by which a bleaching agent and a fabric softener are supplied to the washing machine using a single water supply valve.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a washing machine comprising a first water supply valve for supplying water to a tub upon input of a wash command; and a second water supply valve for supplying water to the tub upon input of the wash command and upon a determination of a final rinse step; a detergent reservoir, coupled to the first water supply valve, for receiving a detergent for a wash step; a bleaching agent reservoir, coupled to the second water supply valve, for receiving a bleaching agent for the wash step; and a fabric softener reservoir, coupled to the bleaching agent reservoir, for receiving a fabric softener for a final rinse step. According to the present invention, the first water supply valve is used as a dedicated valve for the detergent, and the second water supply valve is used as a common input valve for the bleaching agent and fabric softener. Thus, the detergent and bleaching agent are introduced to the water in the tub for the wash step, and the fabric softener is introduced to the water in the tub for the final rinse step only.

Preferably, the second predetermined time is longer than the first predetermined time.

The present invention makes use of a typical wash pattern, whereby a bleaching agent is supplied together with a detergent for a wash step and a fabric softener is supplied only for a final rinse step.

In another aspect of the present invention, there is provided a method of controlling a washing machine having first and second water supply valves. The method comprises steps of determining a water level; supplying water to a tub according to the determined water level, by turning on the first and second water supply valves simultaneously and turning off the second water supply valve after a first predetermined time; performing a wash step and at least one rinse step according to a selected wash course based on the determined water level; determining a final rinse step among the at least one rinse step; and performing the final rinse step according to the determined water level, by turning on the first and second water supply valves simultaneously and turning off the second water supply valve after a second predetermined time.

Also, the employed bleaching agent and fabric softener are each provided in liquid form. Thus, the method of the present invention makes use of a siphonic effect applied to the fabric softener reservoir after performing the wash step.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Figure 1:
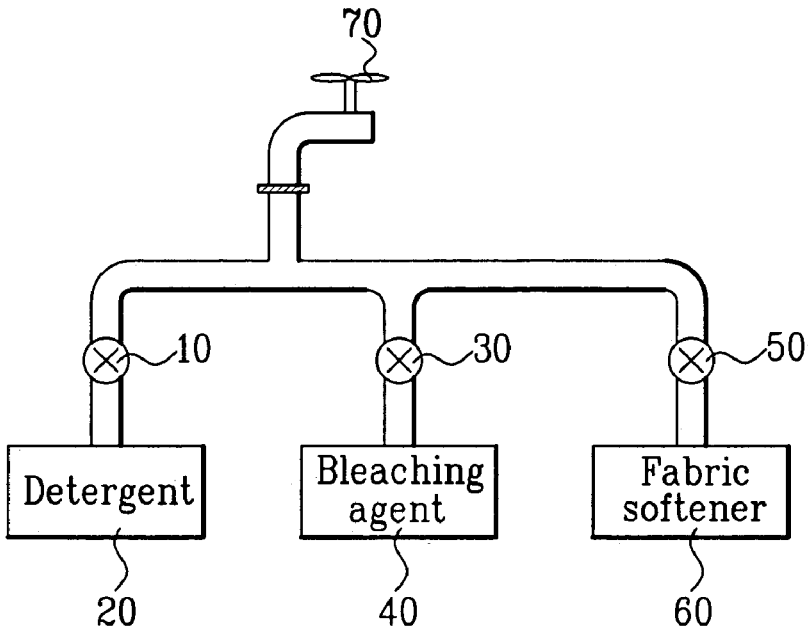
FIG. 1 Related Art
FIG. 1 is a schematic diagram of a water supply valve system of a washing machine according to a related art.
Figure 2:
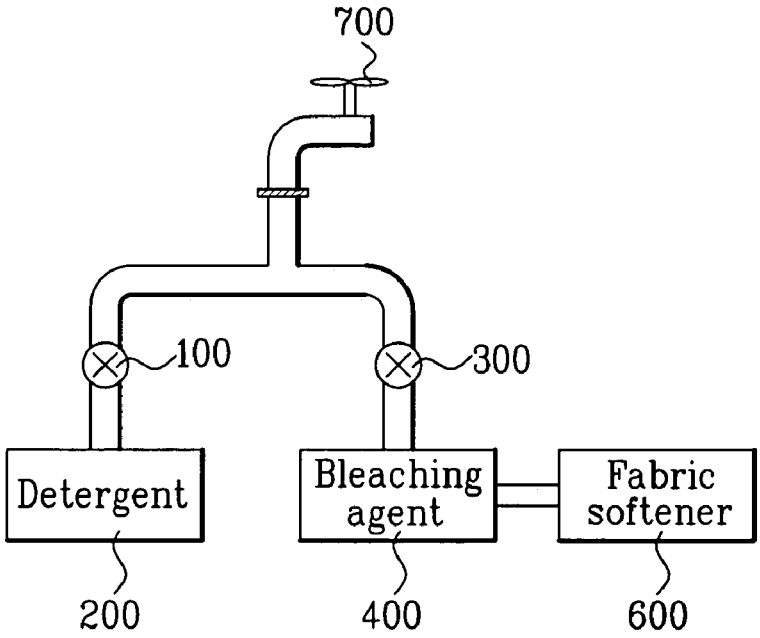
FIG. 2 is a schematic diagram of a water supply valve system of a washing machine according to the present invention.

Reference will now be made in detail to the preferred embodiment of the present invention, examples of which are illustrated in the accompanying drawings. Throughout the drawings, like elements are indicated using the same or similar reference designations where possible.

Referring to FIG. 3, a water supply valve system of a washing machine according to the present invention includes a detergent reservoir 200 for receiving a detergent for a wash step, a bleaching agent reservoir 400 for receiving a bleaching agent for the wash step, a fabric softener reservoir 600 for receiving a fabric softener for a final rinse step, a first water supply valve 100 for the control of a water supply through the detergent reservoir 200 upon input of a wash command, and a second water supply valve 300 for the control of a water supply to the fabric softener reservoir through the bleaching agent reservoir. The second water supply valve 300 is turned on, simultaneously with the first water supply valve 100, to provide the bleaching agent and is turned on again at the time of final rinsing.

In accordance with a wash pattern where a bleaching agent is to be supplied together with a detergent for a wash step and a fabric softener is to be supplied only for a final rinse step, the washing machine of the present invention supplies the water for introducing a bleaching agent, upon input of a wash command to initiate the wash step, through the second water supply valve 300 and supplies the water for introducing a fabric softener for the final rinse step. Meanwhile, according to the present invention, the bleaching agent reservoir 400 is arranged between the second water supply valve 300 and the fabric softener reservoir 600, so that upon initiating the final rinse step, a siphonic effect may be used to transfer water to the fabric softener reservoir through the bleaching agent reservoir. Here, the employed bleaching agent and fabric softener are each provided in liquid form.

Figure 3A:
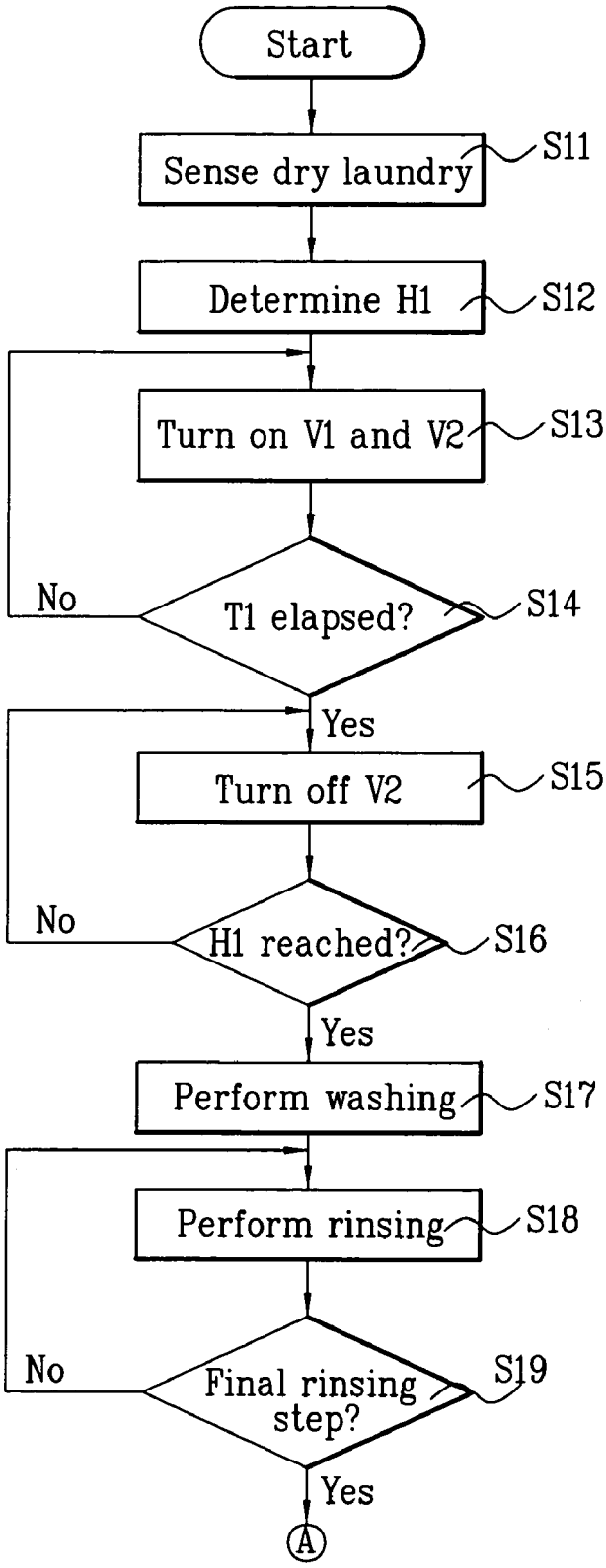
FIGS. 3A and 3B are respective sections of a flowchart of a washing machine control method according to the present invention.
Figure 3B:
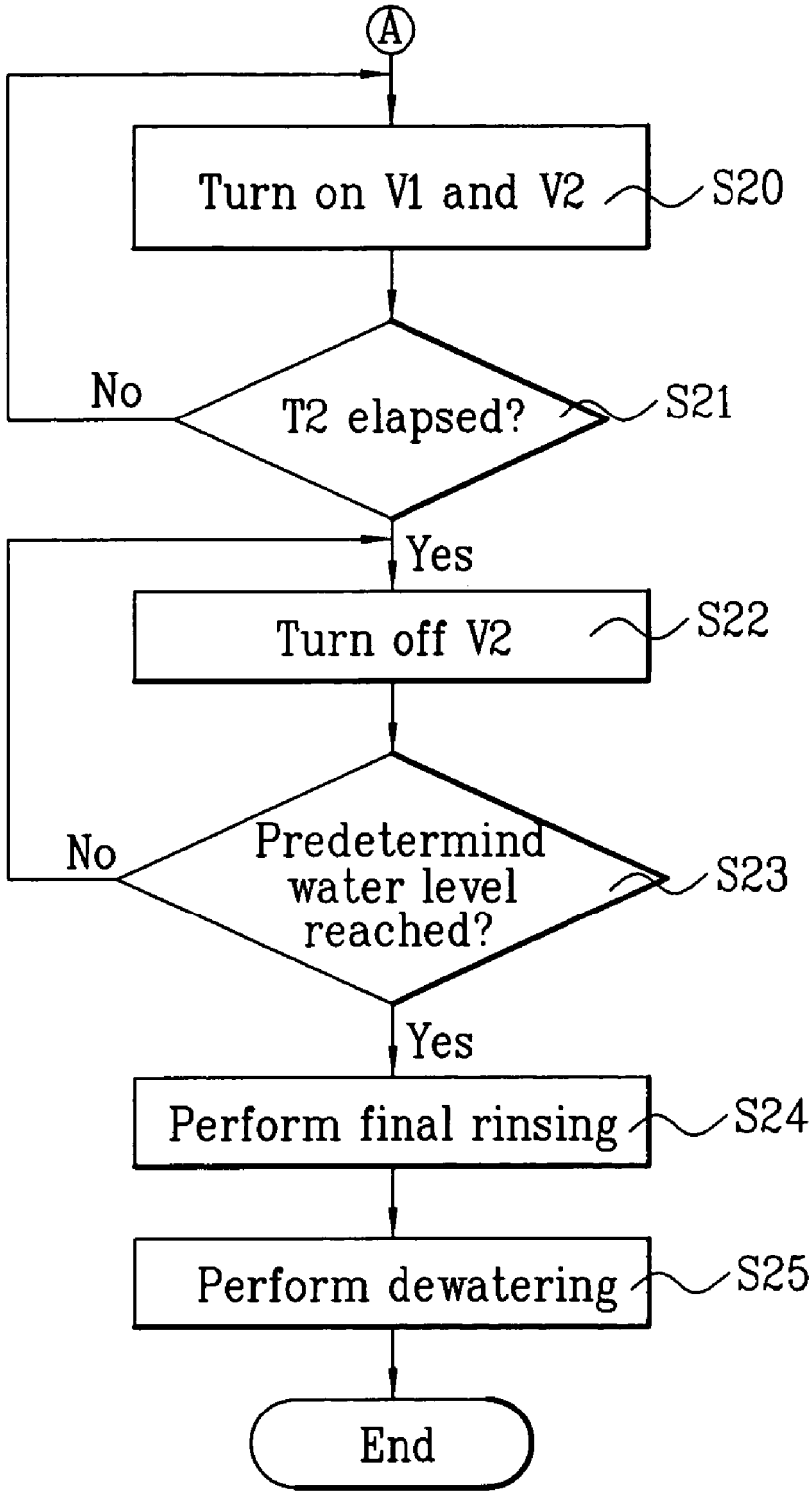

Referring to FIGS. 3A and 3B, illustrating a washing machine control method according to the present invention, a dry laundry amount is sensed in a step S11 upon input of a wash command, and a water level H1 is determined in a step S12 according to the sensed dry laundry amount. In a step S13, the first water supply valve 100 (V1) and the second water supply valve 300 (V2) are turned on simultaneously for a predetermined time T1 according to a step S14, thus simultaneously introducing the detergent of the detergent reservoir 200 and the bleaching agent of the bleaching agent reservoir 400 to the water for the wash step. In doing so, water is prevented from passing by the fabric softener reservoir 600. That is, upon initiating the wash step, water is input via the second water valve 300 through the bleaching agent reservoir 400, to supply the tub with a mixture of water and bleaching agent, but upon reaching the final rinse step, the siphonic effect acting on the fabric softener reservoir 600 causes the water remaining in the bleaching agent reservoir to flow into the fabric softener reservoir, so that a single water supply valve can selectively feed the bleaching agent and fabric softener.

After the lapse of the predetermined time T1, the second water supply valve 300 is turned off in a step S15. Since the first water supply valve 100 is still on according to the step S13, the water level continues to rise until the water level H1 is reached according to a step S16, whereupon washing is performed in a step S17. Thereafter, one or more rinse steps are performed according to steps S18 and S19. During washing and rinsing, the water supply valves 100 and 300 are controlled according to a selected wash pattern.

Before performing the final rinse step, however, the first and second water supply valves 100 and 300 are simultaneously turned on in a step S22 for a second predetermined time T2 according to a step S21, so that water is supplied via the detergent reservoir 200 and via the bleaching agent and fabric softener reservoirs 400 and 600. Thus, the fabric softener of the fabric soften reservoir 600 is introduced to the water for the final rinse step. Here, the second predetermined time T2 is preferably longer than the first predetermined time T1.

Thereafter, the second water supply valve 300 is turned off in a step S22, and the first water supply valve 100 is kept on (according to the step S20) until a predetermined water level, consistent with the water level H1, is reached according to a step S23. Final rinsing is performed in a step S24, and a dewatering step is performed in a step S25.

As described above, the bleaching agent is used together with the detergent. The first water supply valve 100 is used as a detergent input valve and the second water supply valve 300 is used as a common input valve for a bleaching agent and fabric softener, to introduce the fabric softener in the final rinse step only. Therefore, the present invention uses a single valve for introducing the bleaching agent for washing and for introducing the fabric softener for a rinse step as required. Despite such use of a single valve, the bleaching agent is not mixed with the fabric softener.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A washing machine comprising:

a detergent reservoir for receiving a detergent;

a bleaching agent reservoir for receiving a bleaching agent;

a fabric softener reservoir for receiving a fabric softener;

a first water supply valve for supplying water, wherein said first water supply valve is configured to introduce the detergent to a tub;

a second water supply valve for supplying water, wherein said second water supply valve is configured to introduce the bleaching agent and the fabric softener to the tub;

a first conduit connected to the detergent reservoir, wherein the first water supply valve controls water flow through the first conduit and the detergent reservoir; and a second conduit connected to the bleaching agent reservoir, wherein the second water supply valve controls water flow through the second conduit and the bleaching agent and the fabric softener reservoirs.

2. The washing machine as claimed in claim 1, wherein said bleaching agent reservoir is arranged between said second water supply valve and said fabric softener reservoir.

3. A method of controlling a washing machine of claim 1, comprising steps of:

determining a water level;

supplying water to a tub according to the determined water level, by turning on the first and second water supply valves and turning off the second water supply valve after a first predetermined time;

performing a wash step and at least one rinse step according to a selected wash course based on the determined water level;

determining a final rinse step among the at least one rinse step; and performing the final rinse step according to the determined water level, by turning on the first and second water supply valve and turning off the second water supply valve after a second predetermined time.

4. The method as claimed in claim 3, wherein the first predetermined time is shorter than the second predetermined time.

5. The method as claimed in claim 3, wherein the first predetermined time is set to introduce to the water in the tub a detergent from a detergent reservoir and a bleaching agent from a bleaching agent reservoir.

6. The method as claimed in claim 3, wherein the second predetermined time is set to introduce to the water in the tub a fabric softener from a fabric softener reservoir.

7. The method as claimed in claim 6, wherein said final rinse performing step makes use of a siphonic effect applied to the fabric softener reservoir after performing the wash step.

8. The washing machine of claim 1, wherein the first water supply valve is connected to the detergent reservoir.

9. The washing machine of claim 1, wherein the second water supply valve is connected to the bleaching agent reservoir.

10. The washing machine of claim 1, wherein the first and second water supply valves are directly connected to the detergent reservoir and the bleaching agent reservoir, respectively.

11. The washing machine of claim 1, wherein the fabric softener reservoir is directly connected to the bleaching agent reservoir.

12. The washing machine of claim 1, wherein the fabric softener reservoir is connected only to the bleaching agent reservoir and the tub.

13. The washing machine of claim 1, wherein the second water supply valve is configured to selectively introduce the bleaching agent and the fabric softener.

14. The washing machine of claim 1, wherein the second water supply valve is configured to introduce the bleaching agent to the tub upon initiating a washing step.

15. The washing machine of claim 1, wherein the second water supply valve is configured to introduce the fabric softener to the tub upon initiating a final rinsing step.

16. The washing machine of claim 1, wherein the second water supply valve supplies the water to the fabric softener reservoir through the bleaching agent reservoir directly connected thereto for a first predetermined time upon initiating a final rinsing step.

17. The washing machine of claim 16, wherein the water in the bleaching agent reservoir flows into the fabric softener reservoir using a siphonic effect.

18. The washing machine of claim 16, wherein the second water supply valve supplies the water to the bleaching agent reservoir for a second predetermined time upon initiating a washing step, while preventing the water from passing by the fabric softener reservoir.

19. The washing machine of claim 18, wherein the first predetermined time is longer than the second predetermined time.

20. A washing machine including a tub, said washing machine comprising:

a detergent reservoir for receiving a detergent;

a bleaching agent reservoir for receiving a bleaching agent;

a fabric softener reservoir for receiving a fabric softener;

a first water supply valve configured to supply water to the detergent reservoir, thereby introducing the detergent to the tub;

a second water supply valve configured to supply water to the bleaching agent reservoir and the fabric softener reservoir, thereby introducing the bleaching agent and the fabric softener to the tub;

a first conduit connected to the detergent reservoir, wherein the first water supply valve controls water flow through the first conduit and the detergent reservoir; and a second conduit connected to the bleaching agent reservoir, wherein the second water supply valve controls water flow through the second conduit and the bleaching agent and the fabric softener reservoirs;

wherein the bleaching agent reservoir and the fabric softener reservoir are coupled together.

21. The washing machine of claim 20, wherein the first water supply valve is in the first conduit.

22. The washing machine of claim 20, wherein the second water supply valve is in the second conduit.

* * * * *